US005868538A

United States Patent [19]

Rathbun

[11] Patent Number: 5,868,538

[45] Date of Patent: Feb. 9, 1999

[54] QUICK-RELEASE LOCK ASSEMBLY

[75] Inventor: Roderick E. Rathbun, Washington, N.C.

[73] Assignee: R-Tex, LLC, Greenville, N.C.

[21] Appl. No.: 912,542

[22] Filed: Aug. 18, 1997

Related U.S. Application Data

[60] Provisional application No. 60/027,071 Sep. 30, 1996.

[51] Int. Cl. [6] ..... F16B 37/08

[52] U.S. Cl. ..... 411/433; 411/437

[58] Field of Search ..... 411/433, 432, 411/437, 266, 267

[56] References Cited

U.S. PATENT DOCUMENTS

| | | | |
|---|---|---|---|
| 2,736,227 | 2/1956 | Stroble | 411/433 |
| 5,230,596 | 7/1993 | Morad | 411/433 |
| 5,477,709 | 12/1995 | Rowe . | |

FOREIGN PATENT DOCUMENTS

| | | | |
|---|---|---|---|
| 1270240 | 12/1970 | United Kingdom | 411/433 |

*Primary Examiner*—Flemming Saether
*Attorney, Agent, or Firm*—Steven J. Hultquist

[57] ABSTRACT

A yarn roll spindle locking assembly including a push-button type engagement/release mechanism. The locking assembly may be dropped onto a spindle to self-actuating lock in position, and is readily removable from the spindle by pivotal movement of a release element.

20 Claims, 2 Drawing Sheets

QUICK-RELEASE LOCK ASSEMBLY

CROSS-REFERENCE TO RELATED APPLICATIONS

This claims the priority of provisional U.S. patent application Ser. No. 60/027,071, filed Sep. 30, 1996 in the name of Roderick E. Rathbun. The disclosure of such provisional application is hereby incorporated herein by reference in its entirety.

BACKGROUND OF THE INVENTION

1. Field of the Invention

This invention relates generally to a mechanical lock assembly of simple and manually operable character.

2. Description of the Related Art

In the field of locking and securement devices, a wide variety of structural and functional forms exist. Mechanical devices have evolved in a myriad of distinct types, and couplings and fasteners are used in a variety of applications. Examples include hook and loop type fasteners for securing apparel on the person of a wearer, key and combination locks for securing structures against intrusion and/or environmental exposure, and snap, zipper and tie-type fasteners for bags, cases and other containers.

Numerous applications exist for mechanical locks having a quick-connect, quick-release character. In such applications, it is highly desirable, from the standpoint of ease of fabrication and use, to minimize the number of moving parts. Such minimization permits the lock assembly to be simply and efficiently manufactured, as well as rendering it highly reliable, since a minimum number of moving parts decreases wear and increases service life of the lock assembly since failure modes for the device are correspondingly reduced, in relation to more complex locks and structurally intricate locks having a large number of moving parts.

In the textile industry, locking assemblies are employed to secure yarn rolls (typically called "packages" in the industry) on perforate spindles through which dye under high pressure is flowed into the yarn roll for dying of the yarn prior to its further processing. For this purpose, the perforate spindle is provided at its extremity with a threaded end rod on which is secured a lock assembly. Due to shrinkage of the yarn rolls as a result of chemical impregnation and differential temperature effects during the dying operation, simple nut locking members are impractical, since they become loosened in use, and the high pressure of the dye medium is lost as a concomitant of the resulting leakage.

Accordingly, the textile industry has adopted various types of locking assemblies which are adapted to mate with and grippingly engage the threads of the end rod. These conventional locking assemblies for dye spindle usage include various designs in which the assembly contains threaded surface cam members which exert a ratcheting engagement with the threads of the end rod when slid downwardly over the rod into abutting engagement with the outer extremity (shoulder) of the yarn roll.

A major problem which has been experienced in the use of such locking assemblies is that they tend to lock or seize in position on the threaded end rod due to the high pressure on the locking assembly exerted in the distal direction of the rod, so that the locking assembly is extremely difficult to disengage when the dying step is completed. This problem is worsened by the compression effects on the locking assembly by the yarn roll subsequent to the dying operation, particularly when a multiplicity of yarn rolls are vertically stacked on a same spindle. As a result, it is extremely difficult to "break lock" of the assembly and obtain release from the threads of the rod.

More generally, in the use of locks of all types, there is a desire to minimize the manual effort necessary to actuate the lock mechanism for locking and unlocking of the lock assembly. A very simple lock assembly with a minimal number of moving parts offers a number of advantages. First, the lock actuator/deactuator may be correspondingly simple in mechanical structure. Second, the low number of moving parts minimizes friction and inertial resistance in the operation of the lock to open and close it. Third, a minimal number of moving parts correspondingly minimizes the susceptibility of the lock assembly to environmental contaminants, e.g., airborne particulates, relative humidity, sand, soil, grit, etc., so that the locking assembly is less likely to bind or seize in use, than a locking assembly having a greater number of structural components. Fourth, the time required to actuate a lock assembly having a minimal number of parts is typically shorter than is the case with a lock assembly having a large number of coating parts which must be sequentially or corporately engaged and motively operated.

There is therefore a continuing search and need in the textile manufacturing art for yarn roll spindle locking assemblies having a minimal number of moving parts, which are simple to manufacture, efficient to operate in a quick locking and quick releasing fashion, which are physically robust, and which are capable of being manipulated for installation on and removal from the threaded rod of the spindle, with a minimum of manual effort.

Accordingly, it is an object of the present invention to provide an improved yarn roll spindle locking assembly meeting the foregoing criteria.

Other objects and advantages of the present invention will be more fully apparent from the ensuing disclosure and appended claims.

SUMMARY OF T HE INVENTION

In a broad aspect, the present invention relates to a yarn roll spindle locking assembly including a push-button type engagement/release mechanism.

The locking assembly includes a main bail body with top and bottom surfaces, the main bail body having a central bore therein for mounting of the locking assembly on a threaded rod with the threaded rod passing through the central bore of the main bail body. The central bore communicates with a cavity extending radially outwardly within the main bail body from the central bore, the bore and the cavity being open at the top face of the main bail body, and the cavity having a floor in vertically spaced relationship to the top surface of the main bail body. A well is provided in the floor of the cavity. In the well is disposed a biasing element, e.g., a biasing spring, a compressible resilient gasket, a deformable "memory material" element, or other compressible/deformable elastic or resilient element, which extends upwardly to a top spring (biasing element) portion above the floor of the cavity.

A thread-locking jaw member having at an inner portion thereof a generally concave engagement face for contacting the aforementioned threaded rod, is pivotally mounted on a fulcrum structure and extends radially outwardly in the cavity, with a radially outer portion having a bottom surface in contact with the top spring portion of the biasing element.

The engagement face of the thread-locking jaw member is threaded at its upper portion for thread-locking engagement with threads of the threaded rod, and the engagement face is unthreaded at its lower portion for non-binding translation of the threaded rod therepast. The thread-locking jaw member at its radially outer portion has a top surface for manual pivotal translation of the thread-locking jaw member against the biasing element, to compress the biasing element and pivotally translate the thread-locking jaw member from a first position, of thread-locking engagement with threads of a threaded rod when present in the central bore, to a second position, presenting the unthreaded lower portion of the thread-locking jaw member to the threads of a threaded rod when a threaded rod is present in the central bore, for non-binding translation of the threaded rod therepast, with concurrent disengagement of the threaded upper portion of the engagement face of the thread-locking jaw member from the threads of the threaded rod in pivotal translation of the thread-locking jaw member from the first position to the second position, whereby the thread-locking jaw member is selectively manually depressible on the top surface of the radially outer portion thereof, to release the thread-locking jaw member from the threads of the threaded fastener, so that the locking assembly can be removed from engagement with the threaded fastener.

In one embodiment of the invention as broadly described above, the main bail body at a lower part of the well in the floor of the cavity communicates with a bypass drain channel extending from the well to an exterior side surface of the main bail body, for drainage of liquid from the well and cavity, to support the jaw member when the jaw member is in the first position, under the biasing action of the aforementioned biasing element.

In another embodiment of the invention, an interior ridge structure is provided on the floor of the cavity, at the junction of the bore and the cavity. Such ridge structure may for example comprise ridge members in circumferentially spaced-apart relationship to one another at such junction of the bore and the cavity.

As used herein, the term "biasing spring" is intended to be broadly construed to encompass mechanical springs per se, as well as other compressible biasing elements such as for example compressible rubber or other elastomeric dome elements, solid compressible elastomeric bodies, and any other suitable biasing means, by which the thread-locking jaw member is biased to a thread-engaging position in contact with the threads of a threaded rod disposed in the central bore of the main bail body when the biasing element is uncompressed, and which is manually depressible to disengage the threaded upper portion of the jaw member and to pivotally translate the jaw member to a position at which the unthreaded (smooth) lower portion of the jaw member is presented to the threads of the threaded rod, so that the threads of the threaded rod can be slid past the jaw member in contact therewith.

The main bail body may be provided with a transverse bore extending therethrough and communicating with the cavity. The jaw member may likewise be provided with a traverse bore therethrough. By such arrangement, a pivot pin may be passed through the transverse bore of the main bail body and the transverse bore of the jaw member when positioned in the cavity, so that the jaw member is pivotally mounted on the pivot pin, as the aforementioned fulcrum structure.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
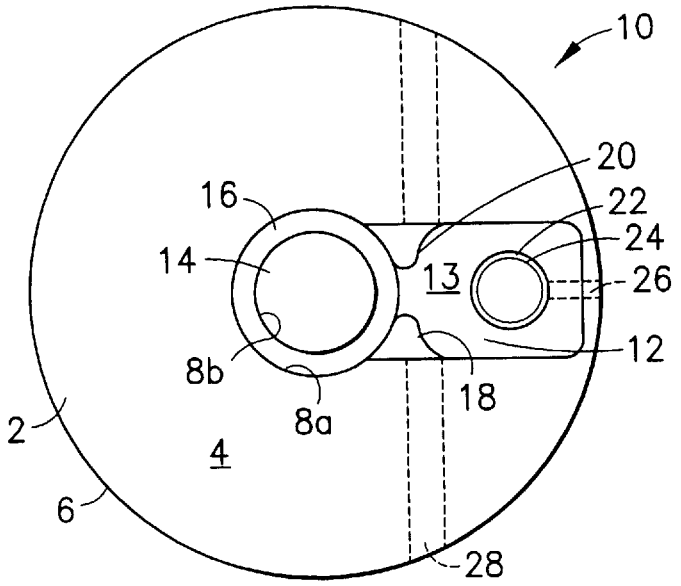
FIG. 1 is a plan view of the main bail body of a locking assembly according to one embodiment of the invention.

Referring now to the drawings, FIG. 1 is a top plan view of a main bail body 2 of a locking assembly 10 according to one embodiment of the invention. The main bail body 2 may be constructed as shown, with a generally circular top surface 4 and a cylindrical side wall surface 6. The main bail body 2 has a central bore 14 therein, bound at an upper portion of the main bail body by a bounding wall 8*a*, and by an interior bounding wall 8*b* at a lower portion of the main bail body. The lower bounding wall 8*b* is of smaller diameter than the upper bounding wall 8*a*, with the junction of such bore portions defining an annular rim 16 of the bore. The central bore 14 communicates with a radially outwardly extending cavity 12, which may be of generally rectangular cross-section as shown. The cavity has a floor 13 which is above the elevation of rim 16 of the central bore 14. The floor 13 of the cavity 12 has a well 22 recessed therein, communicating with a bypass drain channel 26 at a lower extremity of the well. In the well 22 is disposed a biasing element 24, which may comprise a biasing spring or other compressible biasing element. The biasing element extends vertically upwardly from the well above the elevation of floor 13 of the cavity, as illustrated. At the junction of bore 14 and cavity 12 are provided ridge (stop) elements 18 and 20 whose function will subsequently will be described in greater detail. These stop elements 18 and 20 are in circumferentially spaced-apart relationship to one another at the circumference of central bore 14.

Transversely extending through the main bail body 2 of the locking assembly is a transverse bore 28, which communicates with cavity 12 at an elevation above the floor 13 of the cavity.

Figure 2:
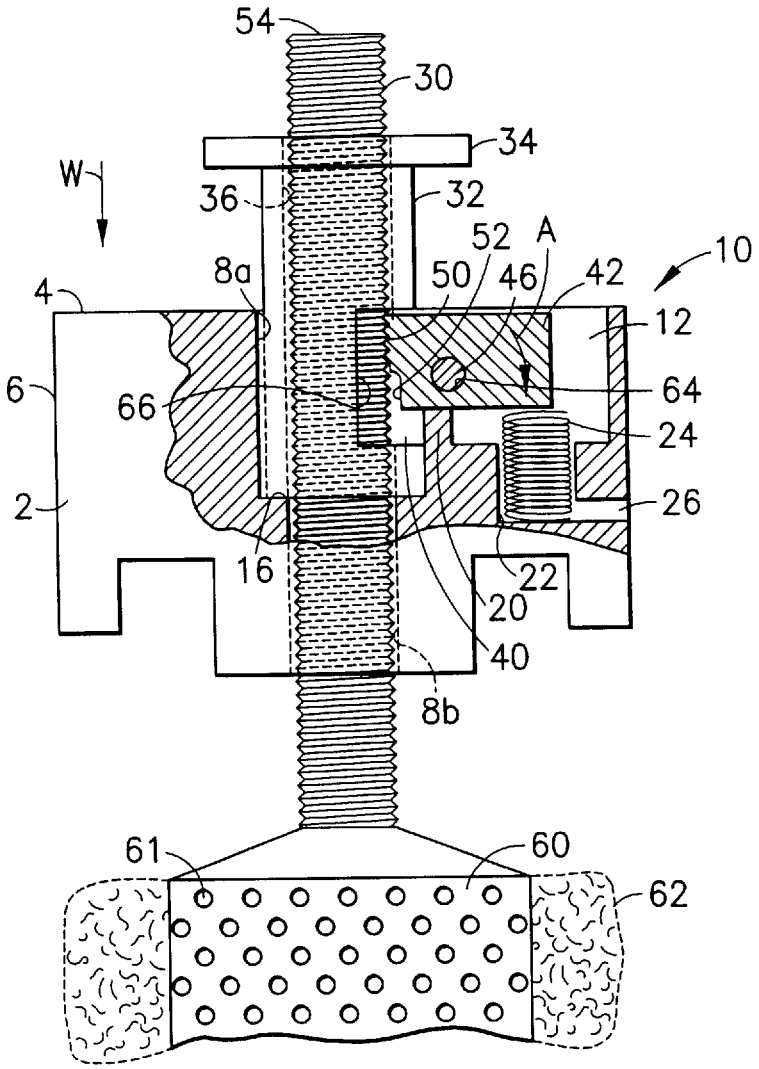
FIG. 2 is a front elevation view, in partial cross-section, of the locking assembly of the present invention, disposed on a threaded rod of a dye spindle on which is mounted a yarn roll.

FIG. 2 is a front elevation view, in partial cross-section, of a locking assembly of the present invention, mounted on a threaded rod of a dye spindle having mounted thereon a yarn roll for dying thereof.

As shown in FIG. 2, the main bail body 2 is mounted on threaded rod 54 which extends vertically upwardly from the dye spindle 60. The dye spindle 60 has mounted thereon a roll 62 of yarn, for high pressure dying thereof, by expression of dye 60 through openings 61 of the dye spindle, so that high pressure dye is forced radially outwardly through the yarn roll 62.

In FIG. 2, wherein corresponding parts have been identically numbered with respect to FIG. 1, a pivot pin 46 is mounted in transverse bore 28 of the main bail body, and pivotally supports a thread-locking jaw member 42, whose radially outer portion is reposed, at the bottom surface thereof, on the top surface of biasing element 24. At a radially inner engagement face of jaw member 42 is provided an upper threaded portion 50 of the engagement face of the jaw member. The jaw member at a lower portion 52 of the engagement face is unthreaded (smooth). The radial jaw member 42 is positioned in a cutout 40 of a collar member 32 having an upper radial flange 34 and constructed with a central bore 36 therethrough, whereby the face 66 of cutout 40 defines a slot matably engaging with the jaw member 42. The collar member 32 at its lower extremity is reposed on rim 16 of the central bore.

In the position shown in FIG. 2, the jaw member 42 is in its normal biased position with the threaded rod passing through the central bore of the locking assembly. In such position, the upper threaded portion 50 of the engagement face is in thread-locking contact with threads 40 of the threaded rod 54. In this position, the locking assembly 10 is positionally secured on the threaded rod, and by downward pressure on the locking assembly exerted in the direction indicated by arrow W, the locking assembly may be brought into abutment with the dye spindle 60 so as to vertically positionally secure the yarn roll 62 on the spindle.

The pivot pin 46 is mounted to be in closely abutting contact with the bounding wall 64 of transverse bore 28, such that the jaw member 42 is manually depressible by pressure exhibited on the top surface of the jaw member at its radially outward position. Such manual pressure induces pivotal translation of the jaw member in the direction indicated by arrow A, so that the biasing element 24 is correspondingly depressed. This translation effects a "quick release" of the locking assembly, as the unthreaded lower portion 52 of the engagement face of the jaw member is translated into contact with the threads 30 of the threaded rod 54. With the unthreaded, smooth-surfaced lower portion 52 of the jaw member in contact with the threads of threaded rod, the locking assembly can readily be slid past the threads of the threaded rod with upward lifting of the locking assembly, e.g., by manual or machine gripping of the collar member 32 or flange 34 thereof, to thereby remove the locking assembly from threaded rod 54.

When installing the locking assembly on the threaded rod 54, the bore of the locking assembly may be slid over the top end of the threaded rod 54 and then "dropped" onto the rod, so that the weight of the locking assembly causes it to slide downwardly over the threaded rod (in the direction indicated by arrow W) to effect a "ratcheting down" translation of the upper threaded portion 50 of the jaw member so that the locking assembly is downward translated over the threads 30 of the threaded rod 54 to a final, locked "down" stop position.

When the locking assembly is locked down against the dye spindle 60, high pressure dye may unavoidably enter the bore of the main bail body 2 and flow into the cavity 12 and well 22. The provision of drain channel 26 permits such liquid to be readily discharged from the interior volume of the main bail body.

Figure 3:
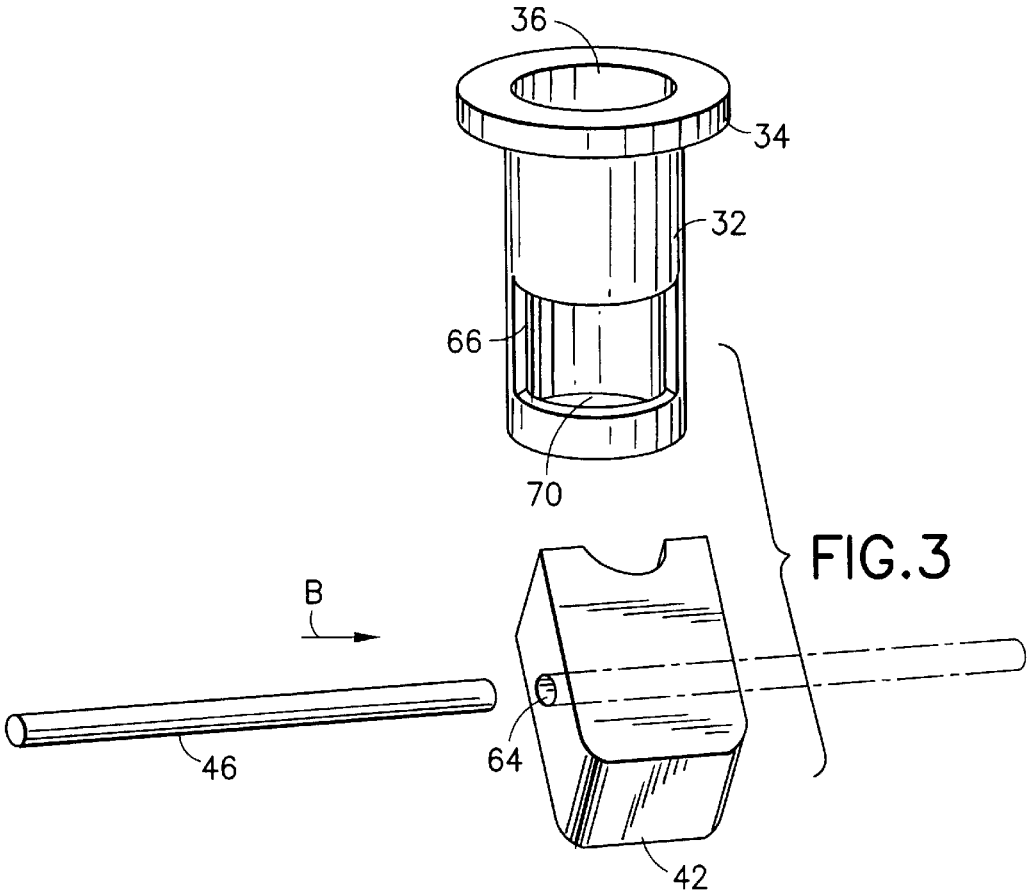
FIG. 3 is a perspective view of several co-acting components of a subassembly of the invention.

The details of the collar member 32 and jaw member 32 are more fully shown in the exploded perspective view of FIG. 3, wherein the pivot pin 46 is illustrated as being translated in the direction of arrow B through transverse bore 64, so that the right-hand end thereof is positioned as shown to the right of jaw member 42 as illustrated in dashed-line representation.

The facing surface 66 of slot 70 in collar member 32 is engaged by the radially inner end of jaw member 42.

Figure 4:
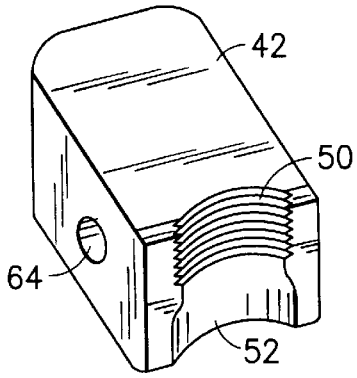
FIG. 4 is a perspective view of a thread-locking jaw member according to the present invention, in one embodiment thereof.

The details of the radially inner engagement face of the jaw member 42 are more fully shown in the perspective view of FIG. 4. As illustrated in such drawing, the inner engagement face includes an upper portion 50 which is threaded to thread-lockingly engage the threads of the threaded rod on the dye spindle. The lower portion 52 of the engagement face is unthreaded and smooth-surfaced, so that in engagement with the threads of the threaded rods on the dye spindle, such smooth surface accommodates sliding movement of the locking assembly, to facilitate quick release and ready removal of the locking assembly, by the simple expedient of depressing the radially outer portion of the jaw member with a thumb or finger, so that the jaw member is pivotally translated on pivot pin 46 to depress the biasing element 24 (see FIG. 2). In installation, the jaw member 42 can be manually disengaged to expose the smooth lower portion 52 to the threading and facilitate downward movement of the locking assembly over the threads of the threaded rod, or with the application of somewhat more increased force, the downward movement of the locking assembly (in the orientation shown in FIG. 2) will ratchetingly displace the threaded upper portion and allow the smooth lower portion of the jaw member to accommodate slide-down of the locking assembly on the threaded rod.

Thus, when the locking assembly is positioned on the threaded rod of a dye spindle in the position to be secured, the upward biasing action of the biasing element 24 (see FIG. 2) will cause the jaw member to correspondingly pivot and bring the threaded upper portion into thread-locked engagement with threads of the threaded rod on the dye spindle. In such thread-locked position, the locking assembly will positionally secure the dye spindle and yarn roll in relation to one another, so that dying of the yarn in the roll can proceed by high pressure force-out of the dye, through the dye spindle and holes in the surface thereof, to the yarn circumscribing the dye spindle.

It will be recognized that the main bail body of the locking assembly of the present invention may be variously configured and may be arranged in a variety of conformations other than the cylindrical form shown and described herein. For example, the main bail body may be of square cross-section, octagonal or polygonal cross-section, or other cross-sectional shape, as may be desired or appropriate in a given end use application of the invention. Nonetheless, the circular cylindrical form shown is preferred in practice, and is particularly useful for manual grasping and positioning of the locking assembly on a threaded rod of a dye spindle.

Although the invention has been illustratively described herein in reference to various features, aspects and embodiments, it will be recognized that the form, construction and operation of the liquid delivery vaporization and vapor deposition system may be widely varied in the broad practice of the present invention, and that variations, modifications and other embodiments are contemplated, within the spirit and scope of the invention as herein disclosed.

What is claimed is:

1. A locking assembly for securing a spool to a threaded rod of a spindle, the assembly comprising:

a cylindrical main body having a generally circular top surface and cylindrical side wall, a central bore therethrough, a cavity, and a transverse bore, the cavity communicating with and extending radially outward from said central bore, and open along its radial extent at the top surface, the cavity having a floor generally parallel to the top surface, with a well recessed therein, and the transverse bore extending through the main body and communicating with said cavity above said floor;

a biasing element disposed in said well and extending vertically upward from the well above the floor of said cavity;

a pivot pin mounted in the transverse bore;

a jaw member of generally block-like form, supported by the pivot pin for pivoting movement between a first position engaged with the threaded rod and a second position disengaged from the threaded rod, the jaw member having an outer portion and an inner engagement face, the outer portion having a top surface and a bottom surface reposed on a top surface of the biasing element, the engagement face having an upper threaded portion and a lower smooth portion, wherein in the first position engaged with the threaded rod, the top surface of the jaw member is substantially parallel to the top surface of the main cylindrical body; and a collar member including a central bore therethrough coaxial with the central bore of the cylindrical main body, wherein the collar member extends upwardly from the top surface of the cylindrical main body.

2. A locking assembly for securing a spool to a threaded rod of a spindle, the assembly comprising:

a main body having a central bore therethrough, a cavity, and a transverse bore, the cavity communicating with and extending radially outward from said central bore, the cavity having a floor with a well recessed therein, and the transverse bore extending through the main body and communicating with said cavity above said floor;

a biasing element disposed in said well and extending vertically upward from the well above the floor of said cavity;

a pivot pin mounted in the transverse bore;

a jaw member supported by the pivot pin, the jaw member having an outer portion and an inner engagement face, the outer portion having a top surface and a bottom surface reposed on a top surface of the biasing element, the engagement face having an upper threaded portion and a lower smooth portion;

a bypass drain channel communicating with the floor of the cavity, for draining liquid from an interior volume of the main body.

3. A locking assembly according to claim 2, wherein the main body central bore is bound at an upper portion by an upper bounding wall and at a lower portion by a lower bounding wall, the lower bounding wall being of a smaller diameter than the upper bounding wall, with an annular rim defined by a junction of the upper and lower bounding walls.

4. A locking assembly according to claim 3, further comprising a collar member having a lower extremity reposed on the annular rim, the collar member including a slot matably engaging with the jaw member.

5. A locking assembly according to claim 4, wherein the collar member includes a central bore therethrough and an upper radial flange, whereby the locking assembly may be quickly released by lifting upwardly on the collar member.

6. A locking assembly according to claim 2, wherein the main body is of cylindrical form.

7. A locking assembly according to claim 2, further comprising at least one ridge element at a junction of the central bore and the cavity.

8. A locking assembly according to claim 7, wherein each ridge element is in circumferentially spaced-apart relationship at a circumference of the central bore.

9. A locking assembly according to claim 2, wherein the cavity has a rectangular cross-section.

10. A locking assembly according to claim 2, wherein the biasing element comprises a spring.

11. A locking assembly according to claim 2, wherein the floor of the cavity is perpendicular to the central bore.

12. A locking assembly according to claim 2, wherein the bypass drain channel communicates with a lower extremity of the recessed well.

13. A dye spindle and spindle lock assembly, comprising:

a dye spindle comprising a perforate surface for supporting a yarn roll thereon, and a threaded spindle rod;

a spindle lock, comprising a main body having a central bore therethrough, a cavity, and a transverse bore, the cavity communicating with and extending radially outward from said central bore, the cavity having a floor with a well recessed therein, and the transverse bore extending through the main body and communicating with said cavity above said floor, a biasing element disposed in said well and extending vertically upward from the well above the floor of said cavity, a pivot pin mounted in the transverse bore, a jaw member supported by the pivot pin, the jaw member having an outer portion and an inner engagement face, the outer portion having a top surface and a bottom surface reposed on a top surface of the biasing element, the engagement face having an upper threaded portion and a lower smooth portion, a bypass drain channel communicating with the floor of the cavity, for draining liquid from an interior volume of the main body;

wherein the threaded spindle rod is passed through the central bore of the spindle lock main body causing the upper threaded portion of the jaw member engagement face to engage the threaded spindle rod and positionally secure the spindle lock to the spindle rod.

14. An assembly according to claim 13, wherein the spindle lock main body central bore is bounded at an upper portion by an upper bounding wall and at a lower portion by a lower bounding wall, the lower bounding wall being of a smaller diameter than the upper bounding wall, with an annular rim defined by a junction of the upper and lower bounding walls.

15. An assembly according to claim 14, the spindle lock further comprising a collar member having a lower extremity reposed on the annular rim, the collar member including a slot matably engaging with the jaw member.

16. An assembly according to claim 15, wherein the collar member includes a central bore therethrough and an upper radial flange, whereby the locking assembly may be quickly released by lifting upwardly on the collar member.

17. An assembly according to claim 13, wherein the spindle lock main body further is of cylindrical form.

18. An assembly according to claim 13, wherein the spindle lock main body further includes at least one ridge element at a junction of the central bore and the cavity.

19. An assembly according to claim 18, wherein each ridge element is in circumferentially spaced-apart relationship at a circumference of the central bore.

20. An assembly according to claim 13, wherein the biasing element is a spring.

* * * * *

UNITED STATES PATENT AND TRADEMARK OFFICE

CERTIFICATE OF CORRECTION

PATENT NO. : 5,868,538

DATED : February 9, 1999

INVENTOR(S) : Roderick E. Rathbun

It is certified that error appears in the above-identified patent and that said Letters Patent is hereby corrected as shown below:

Column 2, Line 23, change "coating" to --coacting--
Column 4, Line 3, change "a plan" to --a top plan--

Signed and Sealed this

Twentieth Day of July, 1999

*Attest:*

*Attesting Officer*

Q. TODD DICKINSON

*Acting Commissioner of Patents and Trademarks*